US009467765B2

(12) United States Patent
Siegumfeldt

(10) Patent No.: US 9,467,765 B2
(45) Date of Patent: Oct. 11, 2016

(54) HEARING INSTRUMENT WITH INTERRUPTABLE MICROPHONE POWER SUPPLY

(71) Applicant: GN ReSound A/S, Ballerup (DK)

(72) Inventor: Peter Siegumfeldt, Frederiksberg (DK)

(73) Assignee: GN ReSound A/S, Ballerup (DK)

( * ) Notice: Subject to any disclaimer, the term of this patent is extended or adjusted under 35 U.S.C. 154(b) by 0 days.

(21) Appl. No.: 14/063,190

(22) Filed: Oct. 25, 2013

(65) Prior Publication Data

US 2015/0110321 A1 Apr. 23, 2015

(30) Foreign Application Priority Data

Oct. 22, 2013 (DK) ..... 2013 70609
Oct. 22, 2013 (EP) ..... 13189758

(51) Int. Cl.
*H04R 29/00* (2006.01)
*H04R 1/10* (2006.01)
*H04R 25/00* (2006.01)

(52) U.S. Cl.
CPC ..... *H04R 1/1041* (2013.01); *H04R 25/407* (2013.01); *H04R 1/1083* (2013.01); *H04R 25/00* (2013.01); *H04R 25/30* (2013.01); *H04R 25/305* (2013.01); *H04R 25/554* (2013.01); *H04R 25/70* (2013.01); *H04R 2225/61* (2013.01); *H04R 2460/03* (2013.01); *H04R 2460/05* (2013.01)

(58) Field of Classification Search
USPC ..... 381/60, 123
See application file for complete search history.

(56) References Cited

U.S. PATENT DOCUMENTS 5,577,511 A * 11/1996 Killion ..... A61B 5/121 381/60
5,835,610 A 11/1998 Ishige et al.
(Continued)

FOREIGN PATENT DOCUMENTS

DE 195 26 175 C1 8/1996
DK 2003 00167 8/2003
(Continued)

OTHER PUBLICATIONS

Second Technical Examination dated May 23, 2014 for related DK Patent Application No. PA 2013 70609, 2 pages.
(Continued)

*Primary Examiner* — Amir Etesam
(74) *Attorney, Agent, or Firm* — Vista IP Law Group, LLP

(57) ABSTRACT

A hearing instrument includes: a first microphone; and a control and processing circuit comprising: a first audio input channel configured to receive a first microphone signal, a second audio input channel configured for receipt of an audio signal, a signal processor for receipt and processing of the first microphone signal and the audio signal according to a hearing loss of a user, a power supply configured to provide a first microphone supply voltage for the first microphone, a first controllable switch comprising a first switch control terminal, the first controllable switch configured to selectively connect the first microphone supply voltage to, and disconnect the first microphone supply voltage from, the first microphone in accordance with a first switch control signal, and a first output port configured to provide the first switch control signal to the first switch control terminal.

9 Claims, 3 Drawing Sheets

(56) References Cited

U.S. PATENT DOCUMENTS

| | | | | |
|---|---|---|---|---|
| 6,154,546 | A * | 11/2000 | Uvacek | 381/60 |
| 6,366,863 | B1 * | 4/2002 | Bye | A61B 5/121 381/23.1 |
| 6,760,457 | B1 | 7/2004 | Bren et al. | |
| 6,914,994 | B1 | 7/2005 | Shennib et al. | |
| 8,229,146 | B2 | 7/2012 | Nielsen | |
| 8,638,960 | B2 | 1/2014 | Gran et al. | |
| 2003/0118199 | A1 * | 6/2003 | Marquis et al. | 381/79 |
| 2005/0207602 | A1 | 9/2005 | van Oerle | |
| 2006/0074572 | A1 * | 4/2006 | Bye et al. | 702/57 |
| 2008/0008339 | A1 | 1/2008 | Ryan et al. | |
| 2008/0157129 | A1 * | 7/2008 | Hsu | H04R 1/04 257/254 |
| 2009/0052707 | A1 | 2/2009 | Hain | |
| 2010/0022269 | A1 | 1/2010 | Terlizzi | |
| 2013/0004003 | A1 | 1/2013 | Tada | |
| 2013/0170680 | A1 | 7/2013 | Gran et al. | |

FOREIGN PATENT DOCUMENTS

| | | | |
|---|---|---|---|
| DK | 2003 00167 | L | 10/2003 |
| JP | 2000-069596 | A | 3/2000 |
| JP | 2000-102098 | A | 4/2000 |
| JP | 2008-211832 | A | 9/2008 |
| WO | WO 00/52959 | | 9/2000 |
| WO | WO 2005/107319 | | 11/2005 |

OTHER PUBLICATIONS

Third Technical Examination (Intention to Grant) dated Sep. 19, 2014 for related DK Patent Application No. PA 2013 70609, 2 pages.

Notification of Reason for Rejection dated Mar. 24, 2015, for corresponding Japanese Patent Application No. 2014-214007, 7 pages.

Extended European Search Report for EP Patent Application No. 13189758.9 dated Mar. 11, 2014 (7 pages).

First Technical Examination for DK Patent Application No. PA 2013 70609 dated Jan. 15, 2014 (4 pages).

Notification of Decision of Rejection dated Nov. 10, 2015 for corresponding Japanese Patent Application No. 2014-214007, 4 pages.

US 8,520,875, 08/2013, Gran et al. (withdrawn)

* cited by examiner

HEARING INSTRUMENT WITH INTERRUPTABLE MICROPHONE POWER SUPPLY

RELATED APPLICATION DATA

This application claims priority to and the benefit of Danish Patent Application No. PA 2013 70609, filed on Oct. 22, 2013, pending, and European Patent Application No. EP 13189758.9, filed on Oct. 22, 2013. The entire disclosures of both of the above applications are expressly incorporated by reference herein.

FIELD

The present application relates to a hearing instrument for use by a user.

The hearing instrument comprises a first microphone for generation of a first microphone signal in response to receipt of sound and the first microphone comprises a positive power supply terminal and a negative power supply terminal. A control and processing circuit of the hearing instrument comprises a first audio input channel coupled to the first microphone signal and a second audio input channel for receipt of a second audio signal. The control and processing circuit comprises a signal processor for receipt and processing of the first microphone signal and the second audio signal according to a hearing loss of the user. A power supply of the control and processing circuit is configured to provide a first microphone supply voltage between the positive and negative power supply terminals of the first microphone. A first controllable switch comprises a first switch control terminal and is configured to selectively connect and disconnect the first microphone supply voltage between the positive and negative power supply terminals of the first microphone in accordance with a first switch control signal. A first controllable output port of the control and processing circuit is configured to provide the first switch control signal to the first switch control terminal.

BACKGROUND

Hearing instruments or hearing aids comprises at least one microphone for receipt of incoming sound such as speech and music. The incoming sound is amplified and processed in a signal processor of the hearing instrument in accordance with one or more preset listening program(s) that typically have been computed from a user's specific hearing deficit for example expressed in an audiogram. An output amplifier delivers the processed sound signal to the user's ear canal via a miniature speaker or receiver that may be housed in a casing of the hearing instrument together with the microphone or separately in an ear plug.

Modern hearing instruments are furthermore providing increasingly sophisticated signal processing functions and user interface functions thanks to rapid progress of digital integrated circuit technology and algorithm development in digital signal processing. Hence, modern hearing instruments typically include a plurality of different listening programs that may utilize various microphone signals as audio input or so-called direct audio input sources delivered e.g. through RF antennas, infrared receivers or magnetic antennas like a telecoil. Furthermore, a modern hearing instrument often includes more than one microphone for example 2, 3 or 4 microphones that may be simultaneously operative under certain conditions to deliver multiple microphone signals. The multiple microphone signals may be exploited to provide various types of noise reduction and beam-forming functions or algorithms. One of the multiple microphone signals may be generated by an ear canal microphone and used for an occlusion suppression function for example as disclosed in U.S. Pat. No. 8,520,875. The selected type and number of signal processing functions are typically associated with a particular listening program that is either selected automatically by a control and processing circuit of the hearing instruments or selected manually by the hearing instrument user via appropriate user actuable control buttons. Hence, a particular listening program will often utilize a specific signal processing function or set of functions that are tailored to particular sound environment of the user. A first listening program may for example comprise a beam-forming function or algorithm and be tailored to noisy sound environments such as a train station or a bar. A second listening program may utilize a single omnidirectional microphone input signal and be tailored to a relatively quiet home or office sound environment etc.

However, a hearing aid microphone consumes a certain amount of power when the microphone is operative to produce a useful microphone signal from the impinging sound such as between about 20 mW and 50 mW. This power consumption is drawn through positive and negative power supply terminals of the microphone that are coupled to a microphone supply voltage of the hearing instrument. The current drawn from the microphone supply voltage depletes the often modest energy capacity of a battery source or cell of the hearing instrument. The power consumption of the hearing aid microphone is typically drawn by various kinds of preamplifiers and other signal processing circuitry housed inside a capsule or housing of the hearing aid microphone. In view of the limited amount of energy stored in typical hearing instrument battery cells, it is desirable to reduce the power consumption of hearing instrument circuitry and components where and whenever possible.

U.S. Pat. No. 6,760,457 B1 discloses a hearing aid with a magnetically activated switch that automatically switches the hearing aid input from a microphone input to a voice coil input in response to the presence of a magnetic field. The magnetic field may be generated by a magnet in a telephone handset such that the hearing instrument automatically switches to voice coil input when the hearing aid user picks up the handset for answering the telephone.

SUMMARY

A first aspect relates to a hearing instrument for use by a user, the hearing instrument comprising a first microphone for generation of a first microphone signal in response to receipt of sound where the first microphone comprises a positive power supply terminal and a negative power supply terminal. The hearing instrument further comprises a control and processing circuit comprising a first audio input channel coupled to the first microphone signal and a second audio input channel for receipt of a second audio signal. A signal processor of the control and processing circuit is configured for receipt and processing of the first microphone signal and the second audio signal according to a hearing loss of the user. A power supply is configured to provide a first microphone supply voltage between the positive and negative power supply terminals, respectively, of the first microphone. A first controllable switch comprises a first switch control terminal and the first controllable switch is configured to selectively connect and disconnect the first microphone supply voltage between the positive and negative power supply terminals of the first microphone in accordance with a first switch control signal. A first controllable output port of the control and processing circuit is configured to provide the first switch control signal to the first switch control terminal.

The capability of the control and processing circuit of the present hearing instrument to disconnect the first microphone supply voltage via the first controllable switch enables a substantial reduction or elimination of the power consumption of one or more non-operative hearing instrument microphone(s) while the hearing instrument otherwise remains operative. The hearing instrument may for example remain operative by reproducing audio input delivered by one of the previously discussed direct audio input sources. As mentioned above, certain listing programs may not require all hearing instrument microphones to be operative simultaneously and indeed certain listening programs may not require even a single operative microphone such as a listening program acquiring its audio input from the above-discussed direct audio input sources. Another advantage of the present hearing instrument is that the control and processing circuit of the hearing instrument is able to control the connection and disconnection of the microphone supply voltage of each of the hearing instrument microphone(s) for example in accordance with a selected listening program such that only required microphones are supplied with power and therefore operative in any selected listening program. Since, the control and processing circuit controls selection of the desired listening program, either automatically or in response to user input, the audio input source or sources used in the selected listening program are known. Hence, the control and processing circuit is capable of identifying and disconnect one or more inoperative microphone(s). It furthermore advantageous that the control and processing circuit is able of controlling the connection and disconnection of the microphone supply voltage of each of the hearing instrument microphone(s) in certain types of signal processing algorithms that rely on an interval based utilization pattern of certain microphone signals. Hence, the voltage supply of the relevant microphone(s) may be disconnected by the control and processing circuit during time intervals where these microphones are unused.

The hearing instrument may for example receive, process and reproduce audio signals to the user delivered from a remote audio source via a wireless or wired receiver coupled to the second audio input channel. In the latter situation, the control and processing circuit may therefore disconnect the microphone voltage supply to the first microphone. According to this embodiment, the hearing instrument further comprises a wireless receiver for receipt of a wireless modulated audio signal and a decoder coupled to the wireless receiver for extracting a wireless audio signal and coupling the wireless audio signal to the second audio input channel or a third audio input channel of the control and processing circuit. The wireless receiver may comprise an appropriate antenna for the selected type of wireless transmission such as an antenna selected from a group of {RF antenna, magnetic antenna, optical receiver}. The RF antenna may for example be configured for receipt of a wireless modulated audio signal according to the Bluetooth standard or the Bluetooth Low energy (Bluetooth LE) standard or according to U.S. Pat. No. 8,229,146. Alternatively, a much lower frequency of communication may be applied for example based on magnetic coupling in which case the magnetic antenna may comprise a traditional telecoil. The optical receiver may comprise a suitable LED based light sensor.

The remote audio source may comprise a portable wireless microphone, such as a ReSound Unite™ Mini Microphone, placed near a sound source such as a speaker, a teacher, a television, a radio or any other type of sound source of interest. The portable wireless microphone pick-up sound close to the sound source and transmits a corresponding modulated audio signal to the wireless receiver of the hearing instrument via a suitable communication link. The modulated audio signal may be coded in digital format for example in accordance with a standardized digital audio protocol.

Since the control and processing circuit of the hearing instrument controls the connection and disconnection of the microphone supply voltage of the first microphone, the control and processing circuit it is capable of identifying and disconnecting the power supply of the first microphone via the first controllable output port when the microphone signal is not required by a selected signal processing function or algorithm executed by the signal processor. In one embodiment at least one processing parameter used to process the first microphone signal is used to set a logic state of the first controllable output port and thereby connect or disconnect the first microphone supply voltage. The at least one processing parameter may for example indicate that an omnidirectional microphone signal is required based on an analysis of the noise characteristics of the first microphone signal. In response, the control and processing circuit may therefore connect the microphone supply voltage to the first microphone.

In an embodiment, the hearing instrument comprises a second microphone for receipt of sound and generation of a corresponding second microphone signal at the second audio input channel. The second microphone comprises a positive power supply terminal and a negative power supply terminal. The control and processing circuit further comprises a microphone supply terminal providing a second microphone supply voltage to the positive and negative power supply terminals of the second microphone and a second controllable switch configured to selectively connect and disconnect the second microphone supply voltage from the positive and negative power supply terminals of the second microphone in accordance with a second switch control signal from the first, or a second, controllable output port connected to the second switch control terminal. Hence, the second microphone signal is coupled to the second audio input channel in this embodiment instead of the above discussed audio input from the remote audio source via the wireless or wired receiver. The skilled person will appreciate that a further embodiment may comprise the previously discussed audio input from the remote audio source via the above-mentioned additional or third audio input channel.

In some embodiments, the microphone signal from the second microphone may only be required during certain time intervals and the control and processing circuit therefore configured to control the second controllable switch to selectively connect and disconnect the second microphone supply voltage according to a temporal utilization pattern of the second microphone. The utilization pattern of second microphone may for example be determined by a particular signal processing function for example a beam-forming function that is activated in an intermittent pattern in response to certain predetermined audio signal characteristics of the incoming microphone signal. In one embodiment, the control and processing circuit is configured to determine the temporal utilization pattern of the second microphone based on an ear canal sound pressure.

Various signal processing functions or algorithms with respective processing parameters may be assembled or bundled to define a particular preset listening program of the hearing instrument such that each preset listening program selects a particular audio signal channel, or set of audio input channels, together with a particular set of signal processing functions that are applied to the audio signals of the selected audio channels. Hence, the control and processing circuit may connect and disconnect supply voltage to each of the first and second microphones in accordance with the selected preset listening program such that only the required microphones are powered and operative in the selected listening program. The preset listening program may either be selected automatically by the control and processing circuit of the hearing instruments for example based on an analysis of the spectral or temporal content of the first and/or second microphone signals or manually by the hearing instrument user via appropriate user actuable control buttons generating appropriate control signals to the control and processing circuit. In an embodiment, the hearing instrument may comprise an omnidirectional listening program, said omnidirectional listening program utilizing a single audio signal channel. In an alternative or additional embodiment, the hearing instrument may comprise a directional listening program, said directional listening program utilizing at least the first and the second audio input channels.

At least the first audio input channel may comprise an analog-to-digital converter generating a digitized microphone signal for a Digital Signal Processor (DSP) of the signal processor. The skilled person will understand that the first audio input channel may comprise additional signal conditioning circuits such as a microphone preamplifier in-front of, or integrated with, the analog-to-digital converter and/or various frequency selective filters to highpass, lowpass or bandpass filter the microphone signal. The second audio input channel may likewise comprise an analog-to-digital converter and various additional signal conditioning circuits adapted to the nature of the audio signal source coupled to the second audio input channel of the control and processing circuit e.g. the second microphone or the remote audio source.

While each of the first and second controllable switches in principle may either be integrated on the control and processing circuit or provided as separate components external to the control and processing circuit, it is preferred that at least one, and preferably both, of the first and second controllable switches is/are integrated on the control and processing circuit. The first controllable switch may for example be arranged in series with the positive and negative power supply terminals of the first microphone and the second controllable switch arranged in series with the positive and negative power supply terminals of the second microphone if the latter is available. The small dimensions of typical hearing instruments and correspondingly small area offered by electronic carrier components of the hearing instruments will often make it advantageous to integrate both the first and second controllable switches with the control and processing circuit. The electronic carrier component may comprise a single-layer or multilayer printed circuit board or ceramic substrate. The control and processing circuit is preferably provided as a single semiconductor die or substrate for example fabricated in sub-micron CMOS processes. In the alternative, at least one, and optionally both, of the first and second controllable switches may be arranged externally to the control and processing circuit in series with the positive and negative power supply terminals of the first microphone or the second microphone. In an embodiment, the controllable switches may be integrated on the microphones.

Each of the first and second controllable switches may comprise a semiconductor switch for example a transistor switch such as a MOSFET switch since the latter is particularly simple to integrate on a sub-micron digital CMOS based semiconductor die or substrate holding the control and processing circuit. If the first and/or second controllable switch is mounted externally to the control and processing circuit, the first and/or second controllable switch may include a miniature electromechanical relay or a MEMS relay etc. The respective switch control terminals of such externally arranged first and/or second controllable switches may be electrically connected to an externally accessible output port or ports of the control and processing circuit via suitable electric wiring of the hearing instrument. The electric wiring may comprise electric traces or wires formed on, or in, the previously discussed electronic carrier component.

The first microphone may comprise a sound inlet or port arranged in a housing or shell of the hearing instrument to pick-up sound from an external environment such as public or private space or room. The housing of the hearing instrument may comprise any known housing style such as Behind-the-Ear (BTE), In-the-Ear (ITE), In-the-Canal (ITC), Completely-in-Canal (CIC) etc. In an embodiment, the second microphone of the hearing instrument may have a second sound inlet arranged in the housing or shell to pick-up the sound from the external environment of the hearing instrument. In this embodiment, the first and second sound inlets are preferably closely spaced on the housing shell e.g. spaced with a distance smaller than 30 mm such as between 5 and 20 mm. This closely spaced arrangement of the sound inlets or ports is beneficial to extract or derive the previously discussed directional microphone signal from the first and second microphone signals. Hence according to this embodiment, the control and processing circuit may be configured to connecting the positive and negative power supply terminals of the first microphone to the first microphone supply voltage and disconnecting the positive and negative power supply terminals of the second microphone from the second microphone supply voltage if a first preset listening program is selected to utilize the first microphone signal only as audio input, e.g. to form an omnidirectional. The control and processing circuit may furthermore connect the positive and negative power supply terminals of the first microphone to the first microphone supply voltage and connects the positive and negative power supply terminals of the second microphone to the second microphone supply voltage if a second preset listening program is selected to combine the first and second microphone signals in the signal processor, e.g. to form a directional microphone signal via a beam-forming function.

In another advantageous embodiment of the present hearing instrument with at least two microphones, the sound inlet of the second microphone is arranged in the housing or shell of the hearing instrument to pick-up sound from a user's ear canal when the hearing instrument is fitted on or in the user's ear. The ability to measure and process the sound pressure in the user's ear canal may be helpful for numerous reasons for example to provide occlusion suppression or cancellation in the hearing instrument while the user speaks.

As mentioned above, the processing circuit may comprise a plurality of preset listening programs utilizing different processing parameters in the signal processor to process at least the first microphone signal. The control and processing circuit may be configured to connect and disconnect at least the first microphone supply voltage via the first controllable output port in accordance with the selected preset listening program. The skilled person will understand that the control and processing circuit may be configured to connect and disconnect the respective microphone supply voltages of any further microphones via additional controllable output ports in accordance with the selected preset listening program. The different processing parameters may have been determined by a hearing aid fitting system in accordance with the user's hearing loss during a fitting session at an audiologist office. The different processing parameters may have been written to the hearing instrument in connection with the fitting session and loaded into a non-volatile data memory space of the hearing instrument. The different processing parameters may have been stored in the non-volatile data memory space such that these are readable by the signal processor during operation of the hearing instrument.

The signal processor preferably comprises a software programmable microprocessor such as a DSP core. Each of the above-discussed signal processing functions and listening programs may comprise a set of executable program instructions that are executed on the software programmable microprocessor core. In the alternative, the signal processor may comprise a hard-wired DSP implemented by an appropriately configured assembly of digital sequential and combinatorial logic circuitry.

The power supply of the control and processing circuit may comprise a DC power supply. In an embodiment, the DC power supply may comprise various types of supply circuitry for example a linear voltage regulator or a switched mode DC-DC power converter and both coupled to a battery source of the control and processing circuit. The battery source of the hearing instrument may be provided by a traditional 1.2 V Zinc-Air battery cell or by one or more rechargeable battery cells. The DC power supply may be configured to deliver a microphone supply voltage with a DC level between 0.9 V and 1.1 V which is suitable for typical hearing instrument microphones. Otherwise, the DC voltage level may be adapted to the voltage supply requirements of any particular type of hearing aid microphone. As mentioned above, each hearing instrument microphone may draw between 20 mW and 50 mW from the microphone supply voltage when it is connected thereto. The DC power supply may comprise boost type switched mode DC-DC power converter if a microphone supply voltage higher than the DC voltage delivered by the battery source is required or a buck type switched mode DC-DC power converter if the microphone supply voltage required is lower than the DC voltage of the battery source.

A hearing instrument for use by a user, includes: a first microphone for generation of a first microphone signal in response to receipt of sound, the first microphone comprising a positive power supply terminal and a negative power supply terminal; and a control and processing circuit comprising: a first audio input channel configured to receive the first microphone signal, a second audio input channel configured for receipt of an audio signal, a signal processor for receipt and processing of the first microphone signal and the audio signal according to a hearing loss of the user, a power supply configured to provide a first microphone supply voltage for the first microphone, a first controllable switch comprising a first switch control terminal, the first controllable switch configured to selectively connect the first microphone supply voltage to, and disconnect the first microphone supply voltage from, the first microphone in accordance with a first switch control signal, and a first output port configured to provide the first switch control signal to the first switch control terminal.

Optionally, the hearing instrument further includes: a second microphone for receipt of sound and generation of a corresponding second microphone signal, the second microphone coupled to the second audio input channel, and comprising a positive power supply terminal and a negative power supply terminal; wherein the control and processing circuit further comprises: a microphone supply terminal providing a second microphone supply voltage to the second microphone, and a second controllable switch comprising a second switch control terminal, the second controllable switch configured to selectively connect the second microphone supply voltage to, and disconnect the second microphone supply voltage from, the second microphone in accordance with a second switch control signal from the first output port, or a second output port, connected to the second switch control terminal.

Optionally, the second microphone comprises a sound inlet arranged in a housing or shell of the hearing instrument to pick-up sound from an ear canal of the user when the hearing instrument is fitted on or in an ear of the user.

Optionally, the control and processing circuit is further configured to control the second controllable switch to selectively connect and disconnect the second microphone supply voltage according to a temporal utilization pattern of the second microphone.

Optionally, the control and processing circuit is configured to determine the temporal utilization pattern of the second microphone based on an ear canal sound pressure.

Optionally, the control and processing circuit comprises a plurality of preset listening programs, and wherein the control and processing circuit is configured for selectively: connecting the positive and negative power supply terminals of the first microphone to the first microphone supply voltage, and disconnecting the positive and negative power supply terminals of the second microphone from the second microphone supply voltage, if a first one of the preset listening programs is selected to utilize the first microphone signal, and not the second microphone signal, as audio input; connecting the positive and negative power supply terminals of the first microphone to the first microphone supply voltage, and connecting the positive and negative power supply terminals of the second microphone to the second microphone supply voltage, if a second one of the preset listening programs is selected to combine the first and second microphone signals in the signal processor.

Optionally, at least one of the first and second controllable switches is arranged in series with the positive and negative power supply terminals of the first microphone or the second microphone.

Optionally, the hearing instrument further includes: a wireless receiver for receipt of a wireless modulated audio signal; and a decoder coupled to the wireless receiver for extracting a wireless audio signal and coupling the wireless audio signal to the second audio input channel or a third audio input channel of the control and processing circuit.

Optionally, the wireless modulated audio signal comprises a digitally coded audio signal.

Optionally, the wireless receiver comprises a RF antenna, a magnetic antenna, or an optical receiver.

Optionally, the hearing instrument further includes: a second microphone; and a second controllable switch; wherein the second controllable switch is external to the control and processing circuit and is arranged in series with the positive and negative power supply terminals of the first microphone or the second microphone.

Optionally, the first microphone comprises a sound inlet arranged in a housing or shell of the hearing instrument to pick-up sound from an external environment.

Optionally, the control and processing circuit comprises a plurality of preset listening programs utilizing different processing parameters in the signal processor to process at least the first microphone signal; and wherein the control and processing circuit is configured to connect and disconnect at least the first microphone supply voltage via the first output port in accordance with a selected one of the preset listening programs.

Optionally, the first audio input channel comprises a microphone preamplifier and an analog-to-digital converter for generating a digitized microphone signal for a Digital Signal Processor (DSP) of the signal processor.

Optionally, the signal processor comprises a software programmable microprocessor core.

Optionally, the power supply comprises a linear voltage regulator or a switched DC-DC power converter.

Optionally, the first controllable switch comprises a MOSFET.

Optionally, the signal processor is configured to set a logic state of the first output port based on at least one processing parameter used to process the first microphone signal.

Other and further aspects and features will be evident from reading the following detailed description.

BRIEF DESCRIPTION OF THE DRAWINGS

The drawings illustrate the design and utility of various features described herein, in which similar elements are referred to by common reference numerals. In order to better appreciate how the above-recited and other advantages and objects are obtained, a more particular description will be rendered, which are illustrated in the accompanying drawings. These drawings depict only exemplary features and are not therefore to be considered limiting in the scope of the claims.

Embodiments will be described in more detail in connection with the appended drawings in which.

DESCRIPTION OF PREFERRED EMBODIMENTS

Figure 1:
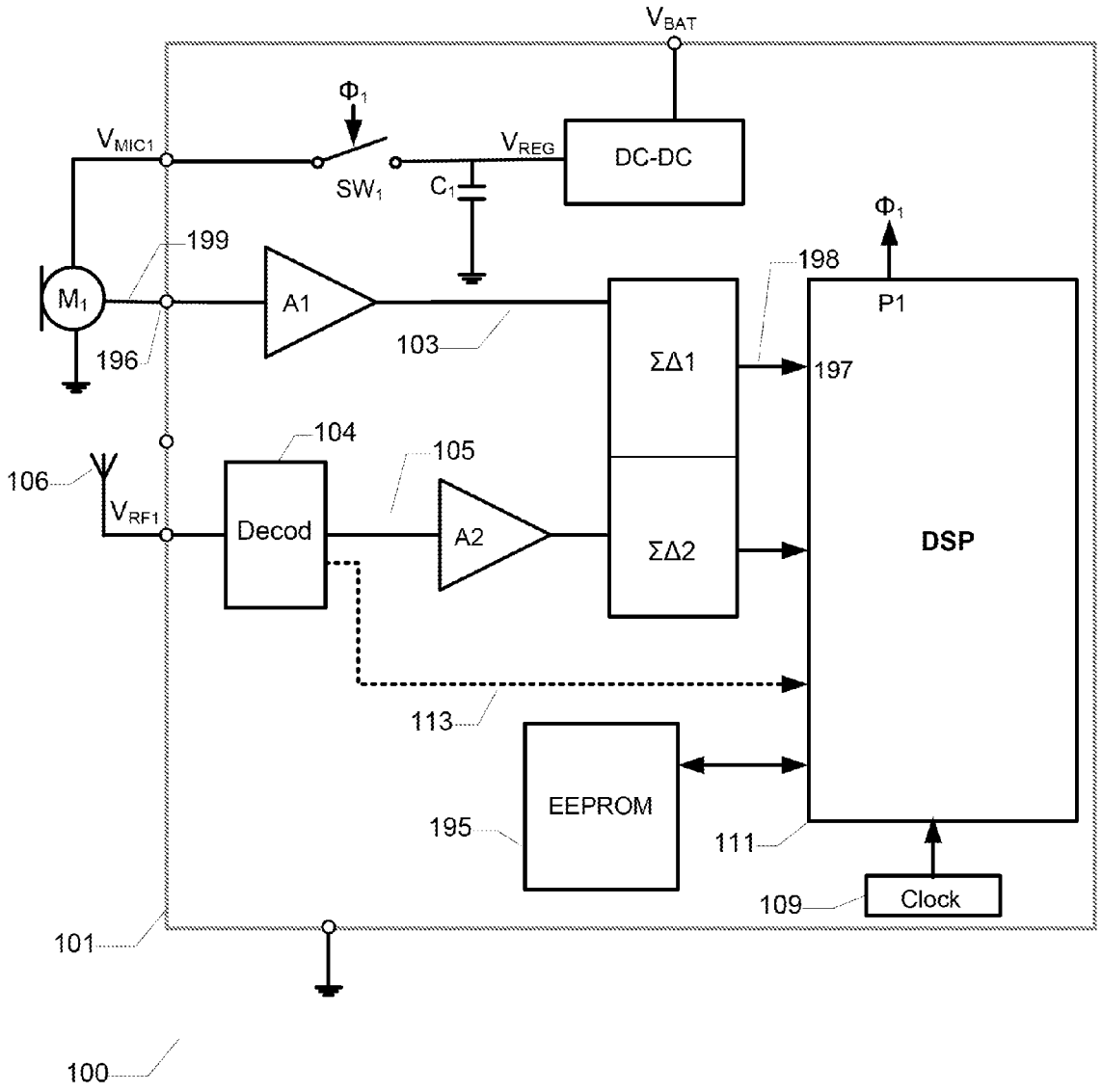
FIG. 1 is a simplified schematic block diagram of a hearing instrument comprising a processor controlled connection and disconnection of microphone power supply in accordance with an embodiment.

Various features are described hereinafter with reference to the figures. It should be noted that the figures are not drawn to scale and that the elements of similar structures or functions are represented by like reference numerals throughout the figures. It should be noted that the figures are only intended to facilitate the description of the features. They are not intended as an exhaustive description of the claimed invention or as a limitation on the scope of the claimed invention. In addition, an illustrated feature needs not have all the aspects or advantages shown. An aspect or an advantage described in conjunction with a particular feature is not necessarily limited to that feature and can be practiced in any other features even if not so illustrated.

FIG. 1 is a simplified schematic block diagram of a hearing instrument 100 comprising a processor controlled connection and disconnection of microphone power supply in accordance with an embodiment. The hearing instrument may comprise any type of hearing aid housing style such as Behind-the-Ear (BTE), In-the-Canal (ITC), Completely-in-Canal (CIC) etc. An output amplifier and a miniature receiver/speaker for production of ear canal sound pressure have both been omitted for simplicity but could in an embodiment be communicatively coupled to an output port or inlet of the processor. The hearing instrument 100 comprises a microphone $M_1$ powered by a positive power supply terminal coupled to a microphone supply voltage terminal $V_{MIC1}$ of a control and processing circuit 101. A negative power supply terminal of the microphone $M_1$ is coupled to a ground potential like a ground terminal of the control and processing circuit 101. Hence, supply power to the microphone $M_1$ flows through the positive and negative power supply terminals and is used to power a microphone preamplifier arranged inside a housing or casing of the microphone. The positive and negative power supply terminals of the microphone $M_1$ may be formed as a pair of externally accessible soldering pads on the housing or casing of the microphone. The microphone $M_1$ further includes a microphone signal terminal or pad which is connected to an output of the microphone preamplifier and supplies a first microphone signal 199 generated in response to incoming sound. The skilled person will appreciate that for certain types of microphones, the audio signal terminal and the positive power supply terminal are provided as a single shared microphone pad or terminal.

The control and processing circuit 101 comprises a first audio input channel 103 coupled to the first microphone signal 199 via an audio input terminal 196 of the control and processing circuit 101. The first audio input channel 103 comprises a microphone preamplifier or buffer A1 delivering an amplified/buffered, and possibly filtered, microphone signal to a first analog-to-digital converter ΣΔ1 to generate a digitized or digital microphone signal 198. The first analog-to-digital converter may comprise a ΣΔ type of converter as indicated on the figure or any other suitable type of analog-to-digital converter such as a flash converter, successive approximation converter etc. The digital microphone signal 198 is applied to a first input channel 197 of a Digital Signal Processor 111 (DSP) of the control and processing circuit 101. The DSP 111 may comprise a software programmable DSP core and may apply one or more signal processing functions to the digital microphone signal 198 under control of a set of executable program instructions or code. The one or more signal processing functions are preferably adapted to process the digital microphone signal according to a hearing loss of a user of the hearing instrument. Hence, various processing parameters of the one or more signal processing functions may have been determined during a preceding hearing aid fitting session with the user at an audiologist office and loaded into a non-volatile data memory space 195 accessible to the DSP 111.

The DSP 111 is clocked by a master clock signal supplied by a clock generator 109 that may have a clock frequency between 1 and 20 MHz. The clock generator 109 may additionally supply synchronous clock signals to the first and a second analog-to-digital converters ΣΔ1, ΣΔ2. The control and processing circuit 101 may also comprise a second audio input channel 105 for receipt of a second so-called direct audio signal via preamplifier A2 and the second analog-to-digital converter ΣΔ2. The second audio input channel 105 furthermore comprises a wireless receiver and decoder 104 in front of the second preamplifier A2. The wireless receiver and decoder 104 is coupled to an RF antenna 106 for receipt of a wireless RF modulated audio signal $V_{RF1}$ there through. The skilled person will understand that the wireless receiver and decoder 104 may operate according to the Bluetooth standard or Bluetooth LE standard or according to U.S. Pat. No. 8,229,146 utilizing digital audio transmission protocols and profiles of the Bluetooth standard or Bluetooth LE standard or according to U.S. Pat. No. 8,229,146. The wireless receiver and decoder 104 may extract the wireless audio signal from the RF modulated audio signal $V_{RF1}$ and apply the latter in analog format to an input of the second preamplifier A2. The output signal of the preamplifier A2 is subsequently digitized in the second analog-to-digital converter ΣΔ2 and applied to a second digital channel of the DSP 111 for further processing in accordance with the user's hearing loss as described earlier. In the alternative, the wireless receiver and decoder 104 may be configured to directly extract or decode the incoming RF modulated audio signal to a digital signal format and apply the digital audio signal to an appropriate digital input channel of the DSP 111. The audio signal routing associated with this direct digital decoding of the RF modulated audio signal is schematically indicated by the dotted line or wire 113.

The control and processing circuit 101 comprises a voltage or power supply such as a DC power supply, DC-DC, configured to provide the previously discussed microphone supply voltage $V_{MIC1}$ between the positive and negative power supply terminals of the microphone $M_1$. The DC power supply, DC-DC, may comprise a relatively simple linear regulator providing a low-noise and ripple free DC microphone supply voltage with a voltage level that is 100-300 mV lower than a battery voltage supplied to a power supply terminal $V_{BAT}$ of the control and processing circuit 101 by a suitable battery source such as a 1.2 V Zinc-Air battery cell. A filtering or smoothing capacitor $C_1$ may be utilized to suppress ripple and noise in the DC microphone supply voltage. A typical hearing aid microphone will draw between 20 and 50 μA of current from the DC voltage supply at a 1 V voltage level. A controllable semiconductor switch $SW_1$ is integrated on the control and processing circuit 101 and coupled in series with the positive and negative power supply terminals of the microphone $M_1$ via the microphone supply voltage terminal $V_{MIC1}$ and the ground terminal of the circuit 101. The skilled person will understand that the controllable semiconductor switch $SW_1$ may comprise different types of semiconductor switches such as a bipolar transistor, a CMOS transistor, a JFET etc. depending e.g. on the semiconductor technology of the control and processing circuit 101 and various application specific requirements. The controllable semiconductor switch $SW_1$ may comprise a MOSFET or a combination of MOSFETs (e.g. a pass-gate coupling) in the present embodiment due to the small size, large off-resistance and low on-resistance of MOSFET switches. The controllable semiconductor switch $SW_1$ comprises a gate terminal or control terminal (not shown) to which a switch control signal $\phi_1$ is applied to selectively connect and disconnect the output voltage $V_{REG}$ of the DC power supply to the microphone $M_1$. A logic high level of the switch control signal $\phi_1$ places $SW_1$ in a conducting state or on-state with low resistance, e.g. less than 1 kΩ. On the other hand, a logic low level of the switch control signal $\phi_1$ places $SW_1$ in a non-conducting state or off-state with large resistance e.g. larger than 1 GΩ. Hence, in the off-state the resistance of $SW_1$ corresponds substantially to an open circuit such that the positive and negative power terminals of the microphone are effectively disconnected from the microphone supply voltage $V_{REG}$ and the current drawn by the microphone reduced to substantially zero. The skilled person will appreciate that the controllable semiconductor switch $SW_1$ in the alternative may be inserted in series with the negative power supply terminal of $M_1$ for example arranged in ground line or wire of the control and processing circuit 101 instead of in series with the microphone supply voltage $V_{REG}$.

The actual voltage level of the switch control signal $\phi_1$ for providing the logic low and high levels will depend on the particular type of the switch for example PMOS or NMOS transistor. The switch control signal $\phi_1$ is supplied by a controllable output port P1 of the control and processing circuit 101 electrically coupled to the gate terminal of $SW_1$ via on-chip electrical wire. A logic level of the controllable output port is controlled by the control and processing circuit 101 e.g. by the previously discussed signal processor 111 or another suitable controller, which is able to write to the controllable output port P1. The controllable output port P1 may for example be mapped to a particular bit value of a peripheral control register (not shown) of the control and processing circuit 101. The skilled person will understand that if the hearing instrument comprises a plurality of microphones, the peripheral control register may contain a plurality of bit values each addressing a particular controllable output port and a corresponding switch control signal of a controllable switch configured to selectively connect and disconnect the microphone supply voltage of each microphone of the plurality of microphones.

As previously mentioned, the DSP 111 may comprise a software programmable DSP core that applies one or more signal processing functions to the digital microphone signal from $M_1$ to process the digital microphone signal 198 according to the hearing loss of the user. These signal processing functions may comprise different processing parameters of functions like non-linear amplification, noise reduction, frequency response shaping etc. which are collected in a first preset listening program. The DSP 111 furthermore comprises at least one additional listening program that does not utilize the microphone signal, but instead uses the previously discussed second direct audio signal supplied by the second audio input channel 105. The DSP 111 may be configured to make the switch between the first and second preset listening programs, and any further available listening program for that matter, in accordance with a control signal supplied by one of the previously discussed user-actuable control buttons. This control signal may for example be routed to a suitable DSP readable input port (not shown) of the control and processing circuit 101. When the control signal indicates the user wishes to switch from the first to the second preset listening program, the DSP 111 in response switches from reading and processing the digital microphone signal of the first input channel 103 to reading and processing the direct digital audio signal from the second audio input channel 105. Furthermore, the DSP 111 proceeds to disconnecting the microphone supply voltage $V_{REG}$ from the microphone via $SW_1$ by writing the appropriate logic state to the controllable port P1 as discussed above. If the user at a later point in time once again presses the user-actuable control button to signal a desire to return to the first preset listening program, the DSP 111 proceeds to re-connecting the microphone supply voltage $V_{REG}$ to the microphone by closing $SW_1$ and read and process the digital microphone signal now again supplied though the first audio input channel 103.

Figure 2:
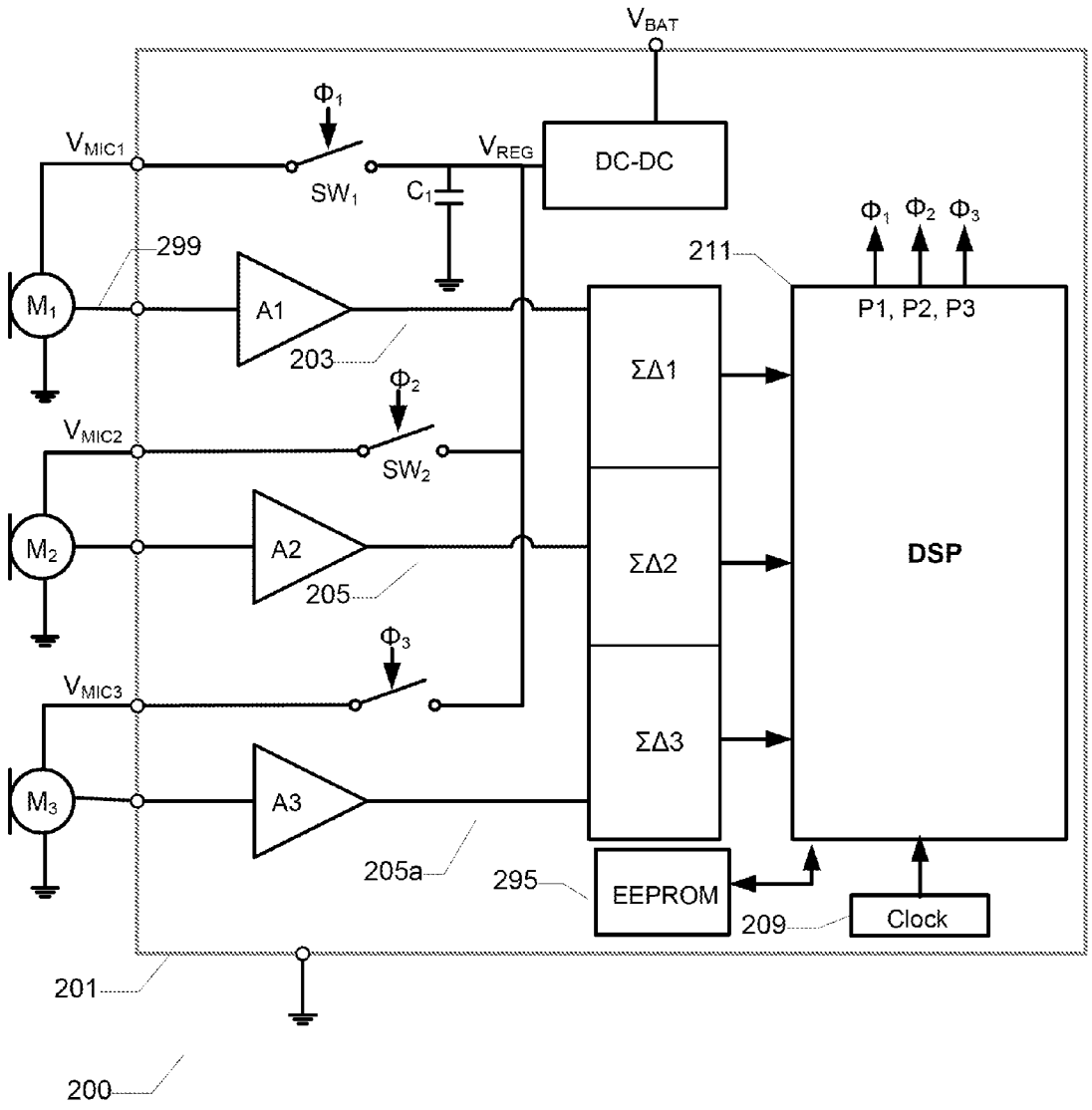
FIG. 2 is a simplified schematic block diagram of a multi-microphone hearing instrument comprising a processor controlled individual connection and disconnection of microphone power supplies in accordance with an embodiment.

FIG. 2 is a simplified schematic block diagram of a multi-microphone hearing instrument 200 comprising a processor controlled individual connection and disconnection of microphone power supplies in accordance with a second embodiment. The same features in the present embodiment and the previously discussed first embodiment have been supplied with corresponding reference numerals to ease comparison. The skilled person will understand that the general remarks made above to the properties of the microphone $M_1$ and the properties of the various circuit blocks of the control and processing circuit 101 are equally applicable to the corresponding microphones $M_1$, $M_2$ and $M_3$ and the corresponding circuit blocks of the control and processing circuit 201. The present multi-microphone hearing instrument 200 comprises three microphones $M_1$, $M_2$ and $M_3$ coupled to a DSP 211 via respective audio input channels 203, 205, 205*a* and not any direct audio input channel. However, the skilled person will understand that other embodiments may additionally comprise such a direct audio input channel similar to the one discussed in connection with the first embodiment. In the present embodiment, the same DC power supply, DC-DC, supplies microphone supply voltage to all three microphones $M_1$, $M_2$ and $M_3$ via respective microphone supply voltage terminals $V_{MIC1}$, $V_{MIC2}$ and $V_{MIC3}$ as illustrated. A controllable semiconductor switch $SW_1$, $SW_2$ and $SW_3$ is arranged between the DC supply voltage $V_{REG}$ supplied by the common DC power supply and each the microphone supply voltage of each of the three microphones $M_1$, $M_2$ and $M_3$. Thereby, each of the microphones $M_1$, $M_2$ and $M_3$ can be individually connected and disconnected to $V_{REG}$ via appropriate gate terminals and appropriate switch control signals $\phi_1$, $\phi_2$ and $\phi_3$ supplied via respective controllable output ports P1, P2 and P3 of the DSP 211. The controllable output ports P1, P2 and P3 are electrically connected to respective switch control terminals (not shown) of the controllable semiconductor switches $SW_1$, $SW_2$ and $SW_3$ and supply appropriate switch control signals $\phi_1$ $\phi_2$ and $\phi_3$, respectively, to the switch control terminals. The skilled person will appreciate that numerous different configurations of the three microphones $M_1$, $M_2$ and $M_3$ and corresponding signal processing functions are possible in different embodiments. In one embodiment, the microphones $M_1$ and $M_2$ may have respective sound inlets arranged at a proximal position in a housing or shell of the hearing instrument 200 to both be able to pick-up sound from an external environment of the hearing instrument. The microphone $M_3$ may on the other hand have a sound inlet arranged in the housing or shell of the hearing instrument to pick-up sound from the user's ear canal when the hearing instrument 200 is placed in the user's ear canal. In this manner, the microphone $M_3$ records or pick-up the user's ear canal sound pressure which may be helpful for numerous reasons for example to provide occlusion suppression or cancellation via a suitable signal processing function. The respective microphone signals delivered by the two microphones $M_1$ and $M_2$ may be utilized by the signal processor to form various kinds of directional or beam-forming functions in a particular listening program or programs. The latter listening program or programs are generally helpful to suppress environmental noise and improve speech intelligibility for the user in noisy environments or surroundings. However, a first listening program, which may be preferable by the user when situated in quiet environments, may utilize omnidirectional microphone input without any occlusion suppression. Consequently, the positive and negative power supply terminals of the first microphone $M_1$ may be connected to the DC supply voltage $V_{REG}$ via $SW_1$ to deliver a microphone signal from microphone $M_1$ to be processed by the DSP 211 while the respective positive and negative power supply terminals of the unused second and third microphone $M_2$ and $M_3$ may be disconnected from the DC supply voltage $V_{REG}$ by the DSP 211 via the controllable output ports P2 and P3 and controllable semiconductor switches $SW_2$ and $SW_3$ in the first listening program. Hence, when the first listening program is active, the power consumption of both the second and third microphone $M_2$ and $M_3$ is eliminated.

Figure 3:
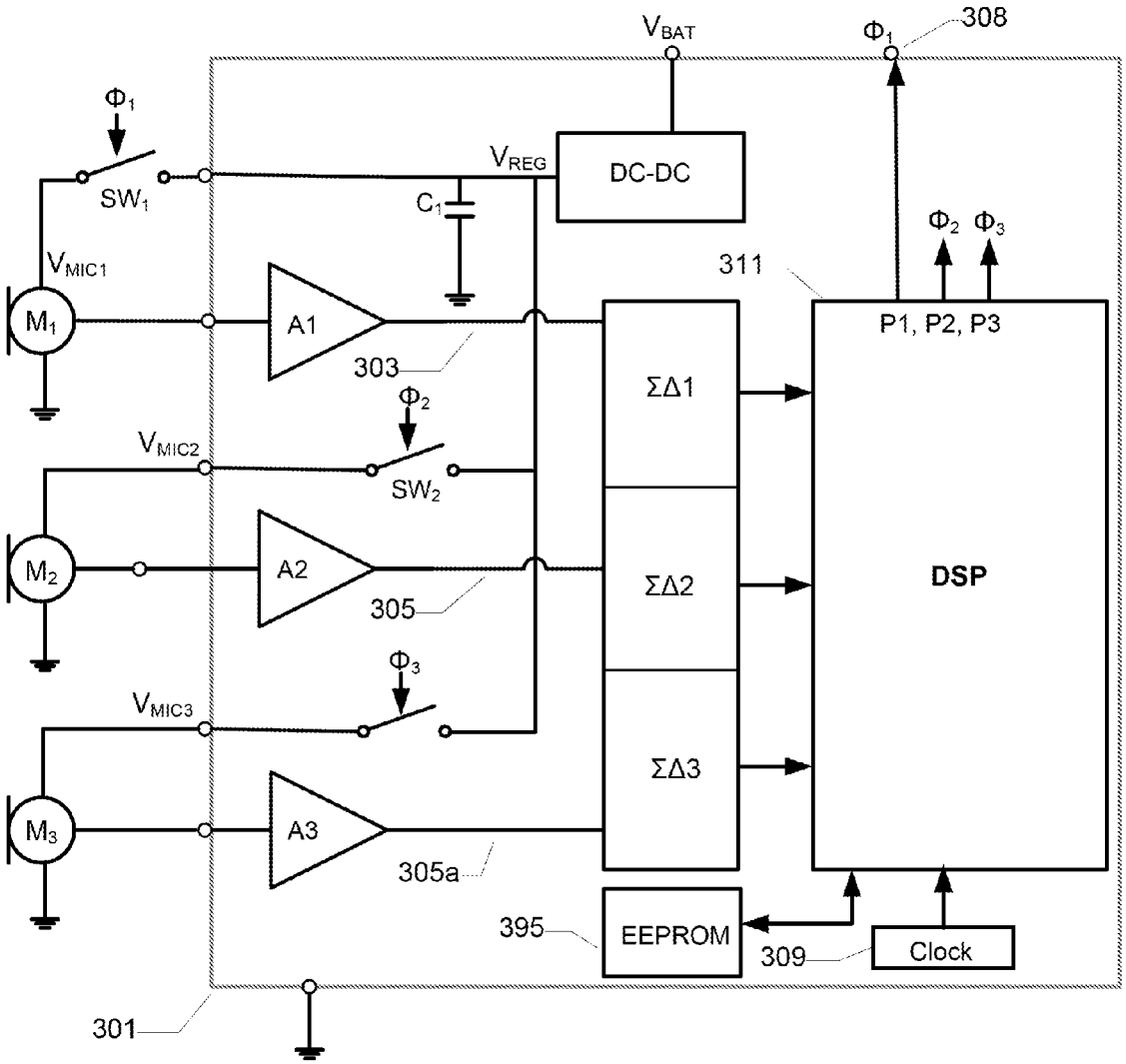
FIG. 3 is a simplified schematic block diagram of a multi-microphone hearing instrument comprising a processor controlled individual connection and disconnection of microphone power supplies in accordance with an embodiment.

FIG. 3 is a simplified schematic block diagram of a multi-microphone hearing instrument 300 comprising a processor controlled individual connection and disconnection of microphone power supplies in accordance with a third embodiment. The same features of the present embodiment and the previously discussed second embodiments have been supplied with corresponding reference numerals to ease comparison. The skilled person will understand that the general remarks above to the properties of the microphones $M_1$-$M_3$ and the properties of the various circuit blocks of the control and processing circuit 201 are equally applicable to the corresponding microphones $M_1$, $M_2$ and $M_3$ and the corresponding circuit blocks of the control and processing circuit 301. The present multi-microphone hearing instrument 300 comprises the three microphones $M_1$, $M_2$ and $M_3$ and not any direct audio input channel. However, the skilled person will understand that other embodiments may additionally comprise such a direct audio input channel similar to the one discussed in connection with the first embodiment. In the present embodiment, a first controllable switch $SW_1$ is formed as a separate component externally to the control and processing circuit 301. The second and third controllable switches $SW_2$ and $SW_3$ are integrated on the control and processing circuit 301 as outlined above in connection with the second embodiment, but may alternatively be supplied as separate external components as well. The skilled person will appreciate that the first controllable switch $SW_1$ may comprise a semiconductor switch for example comprising one or more transistors such as MOSFETs, JFETs, bipolar transistors like the previously discussed integrally formed (i.e. on the control and processing circuit 301) controllable semiconductor switches $SW_1$, $SW_2$ and $SW_3$. However, the first controllable switch SW1 may alternatively comprise a miniature electromechanical relay or other types of relays.

The switch control signal $\phi_1$ is applied to a switch control terminal (not shown) of the first controllable switch $SW_1$ via an externally accessible output port P1 and pad 308 of the control and processing circuit 301. The controllable output port P1 may for example be mapped to a particular I/O address of an I/O address space of the control and processing circuit 101. The skilled person will understand that various level translation circuitry may be inserted between the output port 308 and the switch control terminal of $SW_1$ if required to provide an appropriate voltage level of the switch control signal.

The skilled person will understand that the illustrated separate controllable output ports P1, P2 and P3 in other embodiments may be replaced with a single output port with encoded switch addressing of the controllable semiconductor switches $SW_1$, $SW_2$ and $SW_3$. In this embodiment suitable decoding logic may be added to decode and provide each of the switch control signals $\phi_1$ $\phi_2$ and $\phi_3$, respectively, from the encoded switch addresses supplied via the single output port.

In the above embodiments, the hearing instrument has been described as having a signal processor. As used in this specification, the term "signal processor" is not limited to a certain type of processor, and may refer to one or more processors, such as a FPGA processor, an ASIC processor, a general purpose processor, or any of other types of processor, that is capable of processing signals. Also, the "signal processor" may be implemented using hardware, software, or combination of both hardware and software. Furthermore, the "signal processor" may refer to any integrated circuit, or a portion of an integrated circuit.

One or more embodiments described herein may include one or more aspects according to one or more of the below items.

Items:

1. A hearing instrument for use by a user, the hearing instrument comprising:
a first microphone for generation of a first microphone signal in response to receipt of sound,
the first microphone comprising a positive power supply terminal and a negative power supply terminal;
a control and processing circuit comprising:
a first audio input channel coupled to the first microphone signal,
a second audio input channel configured for receipt of a second audio signal,
a signal processor for receipt and processing of the first microphone signal and the second audio signal according to a hearing loss of the user,
a power supply configured to provide a first microphone supply voltage between the positive and negative power supply terminals of the first microphone,
a first controllable switch comprising a first switch control terminal where the first controllable switch is configured to selectively connect and disconnect the first microphone supply voltage between the positive and negative power supply terminals of the first microphone in accordance with a first switch control signal,
a first controllable output port configured to provide the first switch control signal to the first switch control terminal.

2. A hearing instrument according to item 1, further comprising:
a second microphone for receipt of sound and generation of a corresponding second microphone signal at the second audio input channel,
the second microphone comprising a positive power supply terminal and a negative power supply terminal;
the control and processing circuit further comprising:
a microphone supply terminal providing a second microphone supply voltage to the positive and negative power supply terminals of the second microphone,
a second controllable switch configured to selectively connect and disconnect the second microphone supply voltage from the positive and negative power supply terminals of the second microphone in accordance with a second switch control signal from the first, or a second, controllable output port connected to the second switch control terminal.

3. A hearing instrument according to item 1 or 2, further comprising:
a wireless receiver for receipt of a wireless modulated audio signal,
a decoder coupled to the wireless receiver for extracting a wireless audio signal and coupling the wireless audio signal to the second audio input channel or a third audio input channel of the control and processing circuit.

4. A hearing instrument according to item 3, wherein the wireless modulated audio signal comprises a digitally coded audio signal.

5. A hearing instrument according to item 4, wherein the wireless receiver comprises an antenna selected from a group of {RF antenna, magnetic antenna, optical receiver}.

6. A hearing instrument according to any of the preceding items, wherein at least one of the first and second controllable switches is integrated on the control and processing circuit and arranged in series with the positive and negative power supply terminals of the first microphone or the second microphone.

7. A hearing instrument according to any of the preceding items, wherein at least one of the first and second controllable switches is arranged externally to the control and processing circuit and in series with the positive and negative power supply terminals of the first microphone or the second microphone.

8. A hearing instrument according to any of the preceding items, wherein the first microphone comprises a sound inlet arranged in a housing or shell of the hearing instrument to pick-up sound from an external environment.

9. A hearing instrument according to any of items 2-8, wherein the second microphone comprises a sound inlet arranged in a housing or shell of the hearing instrument to pick-up sound from a user's ear canal when the hearing instrument is fitted on or in the user's ear.

10. A hearing instrument according to any of the preceding items, wherein the control and processing circuit comprises a plurality of preset listening programs utilizing different processing parameters in the signal processor to process at least the first microphone signal; and
the control and processing circuit is configured to connect and disconnect at least the first microphone supply voltage via the first controllable output port in accordance with the selected preset listening program.

11. A hearing instrument according to item 10, wherein the control and processing circuit is configured to:
connecting the positive and negative power supply terminals of the first microphone to the first microphone supply voltage and disconnecting the positive and negative power supply terminals of the second microphone from the second microphone supply voltage if a first preset listening program is selected to utilize the first microphone signal only as audio input;
connecting the positive and negative power supply terminals of the first microphone to the first microphone supply voltage and connecting the positive and negative power supply terminals of the second microphone to the second microphone supply voltage if a second preset listening program is selected to combine the first and second microphone signals in the signal processor e.g. to form a directional microphone signal via a beam-forming function.

12. A hearing instrument according to item any of the preceding items, wherein at least the first audio input signal channels comprises a microphone preamplifier and analog-to-digital converter for generating a digitized microphone signal for a Digital Signal Processor (DSP) of the signal processor.

13. A hearing instrument according to item 11, wherein the signal processor comprises a software programmable microprocessor core such as a DSP core.

14. A hearing instrument according to any of the preceding items, wherein the power supply comprises a linear voltage regulator or a switched DC-DC power converter such as a boost converter, buck converter or charge pump, coupled to a battery supply voltage of the control and processing circuit.

15. A hearing instrument according to any of the preceding items, wherein each of the first and second controllable switches comprises a semiconductor switch such as a MOSFET.

16. A hearing instrument according to any of the preceding items, wherein the signal processor is configured to set a logic state of the first controllable output port based on at least one processing parameter used to process the first microphone signal.

17. A hearing instrument according to anyone of items 2-16, wherein the control and processing circuit is further configured to control the second controllable switch to selectively connect and disconnect the second microphone supply voltage according to a temporal utilization pattern of the second microphone.

18. A hearing instrument according to item 17, wherein the control and processing circuit is configured to determine the temporal utilization pattern of the second microphone based on an ear canal sound pressure.

19. A hearing instrument for use by a user, comprising:

a first microphone for generation of a first microphone signal in response to receipt of sound, the first microphone comprising a positive power supply terminal and a negative power supply terminal; and a control and processing circuit comprising:

a first audio input channel configured to receive the first microphone signal, a second audio input channel configured for receipt of an audio signal, a signal processor for receipt and processing of the first microphone signal and the audio signal according to a hearing loss of the user, a power supply configured to provide a first microphone supply voltage for the first microphone, a first controllable switch comprising a first switch control terminal, the first controllable switch configured to selectively connect the first microphone supply voltage to, and disconnect the first microphone supply voltage from, the first microphone in accordance with a first switch control signal, and a first output port configured to provide the first switch control signal to the first switch control terminal.

20. The hearing instrument according to item 19, further comprising:

a second microphone for receipt of sound and generation of a corresponding second microphone signal, the second microphone coupled to the second audio input channel, and comprising a positive power supply terminal and a negative power supply terminal;

wherein the control and processing circuit further comprises:

a microphone supply terminal providing a second microphone supply voltage to the second microphone, and a second controllable switch comprising a second switch control terminal, the second controllable switch configured to selectively connect the second microphone supply voltage to, and disconnect the second microphone supply voltage from, the second microphone in accordance with a second switch control signal from the first output port, or a second output port, connected to the second switch control terminal.

21. The hearing instrument according to item 20, wherein the second microphone comprises a sound inlet arranged in a housing or shell of the hearing instrument to pick-up sound from an ear canal of the user when the hearing instrument is fitted on or in an ear of the user.

22. The hearing instrument according to item 20, wherein the control and processing circuit is further configured to control the second controllable switch to selectively connect and disconnect the second microphone supply voltage according to a temporal utilization pattern of the second microphone.

23. The hearing instrument according to item 22, wherein the control and processing circuit is configured to determine the temporal utilization pattern of the second microphone based on an ear canal sound pressure.

24. The hearing instrument according to item 20, wherein the control and processing circuit comprises a plurality of preset listening programs, and wherein the control and processing circuit is configured for selectively:

connecting the positive and negative power supply terminals of the first microphone to the first microphone supply voltage, and disconnecting the positive and negative power supply terminals of the second microphone from the second microphone supply voltage, if a first one of the preset listening programs is selected to utilize the first microphone signal, and not the second microphone signal, as audio input;

connecting the positive and negative power supply terminals of the first microphone to the first microphone supply voltage, and connecting the positive and negative power supply terminals of the second microphone to the second microphone supply voltage, if a second one of the preset listening programs is selected to combine the first and second microphone signals in the signal processor.

25. The hearing instrument according to item 20, wherein at least one of the first and second controllable switches is arranged in series with the positive and negative power supply terminals of the first microphone or the second microphone.

26. The hearing instrument according to item 19, further comprising:

a wireless receiver for receipt of a wireless modulated audio signal; and a decoder coupled to the wireless receiver for extracting a wireless audio signal and coupling the wireless audio signal to the second audio input channel or a third audio input channel of the control and processing circuit.

27. The hearing instrument according to item 26, wherein the wireless modulated audio signal comprises a digitally coded audio signal.

28. The hearing instrument according to item 26, wherein the wireless receiver comprises a RF antenna, a magnetic antenna, or an optical receiver.

29. The hearing instrument according to item 19, further comprising:

a second microphone; and a second controllable switch;

wherein the second controllable switch is external to the control and processing circuit and is arranged in series with the positive and negative power supply terminals of the first microphone or the second microphone.

30. The hearing instrument according to item 19, wherein the first microphone comprises a sound inlet arranged in a housing or shell of the hearing instrument to pick-up sound from an external environment.

31. The hearing instrument according to item 19, wherein the control and processing circuit comprises a plurality of preset listening programs utilizing different processing parameters in the signal processor to process at least the first microphone signal; and wherein the control and processing circuit is configured to connect and disconnect at least the first microphone supply voltage via the first output port in accordance with a selected one of the preset listening programs.

32. The hearing instrument according to item 19, wherein the first audio input channel comprises a microphone pre-amplifier and an analog-to-digital converter for generating a digitized microphone signal for a Digital Signal Processor (DSP) of the signal processor.

33. The hearing instrument according to item 32, wherein the signal processor comprises a software programmable microprocessor core.

34. The hearing instrument according to item 19, wherein the power supply comprises a linear voltage regulator or a switched DC-DC power converter.

35. The hearing instrument according to item 19, wherein the first controllable switch comprises a MOSFET.

36. The hearing instrument according to item 19, wherein the signal processor is configured to set a logic state of the first output port based on at least one processing parameter used to process the first microphone signal.

Although particular features have been shown and described, it will be understood that they are not intended to limit the claimed invention, and it will be made obvious to those skilled in the art that various changes and modifications may be made without departing from the spirit and scope of the claimed invention. The specification and drawings are, accordingly to be regarded in an illustrative rather than restrictive sense. The claimed invention is intended to cover all alternatives, modifications and equivalents.

The invention claimed is:

1. A hearing instrument for use by a user, comprising:

a first microphone for generation of a first microphone signal in response to receipt of sound, the first microphone comprising a positive power supply terminal and a negative power supply terminal; and a control and processing circuit comprising:

a first audio input channel configured to receive the first microphone signal, a second audio input channel configured for receipt of an audio signal, a signal processor for receipt and processing of the first microphone signal and the audio signal according to a hearing loss of the user, a power supply configured to provide a first microphone supply voltage for the first microphone, a first controllable switch comprising a first switch control terminal, the first controllable switch configured to selectively connect the first microphone supply voltage to, and disconnect the first microphone supply voltage from, the first microphone in accordance with a first switch control signal, and a first output port configured to provide the first switch control signal to the first switch control terminal;

wherein the signal processor is configured to set a logic state of the first output port based on at least one processing parameter used to process the first microphone signal;

wherein the control and processing circuit further comprises a plurality of preset listening programs utilizing different processing parameters in the signal processor to process at least the first microphone signal; and wherein the control and processing circuit is configured to connect and disconnect at least the first microphone supply voltage via the first output port in accordance with a selected one of the preset listening programs.

2. The hearing instrument according to claim 1, further comprising:

a second microphone for receipt of sound and generation of a corresponding second microphone signal, the second microphone coupled to the second audio input channel;

wherein the control and processing circuit further comprises:

a microphone supply terminal providing a second microphone supply voltage to the second microphone, and a second controllable switch comprising a second switch control terminal, the second controllable switch configured to selectively connect the second microphone supply voltage to, and disconnect the second microphone supply voltage from, the second microphone in accordance with a second switch control signal from the first output port, or a second output port, connected to the second switch control terminal.

3. The hearing instrument according to claim 2, wherein the second microphone comprises a sound inlet arranged in a housing or shell of the hearing instrument to pick-up sound from an ear canal of the user when the hearing instrument is fitted on or in an ear of the user.

4. A hearing instrument for use by a user, comprising:

a first microphone for generation of a first microphone signal in response to receipt of sound, the first microphone comprising a first positive power supply terminal and a first negative power supply terminal; and a control and processing circuit comprising:

a first audio input channel configured to receive the first microphone signal, a second audio input channel configured for receipt of an audio signal, a signal processor for receipt and processing of the first microphone signal and the audio signal according to a hearing loss of the user, a power supply configured to provide a first microphone supply voltage for the first microphone, a first controllable switch comprising a first switch control terminal, the first controllable switch configured to selectively connect the first microphone supply voltage to, and disconnect the first microphone supply voltage from, the first microphone in accordance with a first switch control signal, and a first output port configured to provide the first switch control signal to the first switch control terminal;

wherein the signal processor is configured to set a logic state of the first output port based on at least one processing parameter used to process the first microphone signal;

wherein the hearing instrument further comprises a second microphone for receipt of sound and generation of a corresponding second microphone signal, the second microphone coupled to the second audio input channel, and comprising a second positive power supply terminal and a second negative power supply terminal;

wherein the control and processing circuit further comprises:

a microphone supply terminal providing a second microphone supply voltage to the second microphone, and a second controllable switch comprising a second switch control terminal, the second controllable switch configured to selectively connect the second microphone supply voltage to, and disconnect the second microphone supply voltage from, the second microphone in accordance with a second switch control signal from the first output port, or a second output port, connected to the second switch control terminal; and wherein the control and processing circuit is further configured to control the second controllable switch to selectively connect and disconnect the second microphone supply voltage according to a temporal utilization pattern of the second microphone.

5. The hearing instrument according to claim 4, wherein the control and processing circuit is configured to determine the temporal utilization pattern of the second microphone based on an ear canal sound pressure.

6. A hearing instrument for use by a user, comprising:

a first microphone for generation of a first microphone signal in response to receipt of sound, the first microphone comprising a first positive power supply terminal and a first negative power supply terminal; and a control and processing circuit comprising:

a first audio input channel configured to receive the first microphone signal, a second audio input channel configured for receipt of an audio signal, a signal processor for receipt and processing of the first microphone signal and the audio signal according to a hearing loss of the user, a power supply configured to provide a first microphone supply voltage for the first microphone, a first controllable switch comprising a first switch control terminal, the first controllable switch configured to selectively connect the first microphone supply voltage to, and disconnect the first microphone supply voltage from, the first microphone in accordance with a first switch control signal, and a first output port configured to provide the first switch control signal to the first switch control terminal;

wherein the signal processor is configured to set a logic state of the first output port based on at least one processing parameter used to process the first microphone signal;

wherein the hearing instrument further comprises a second microphone for receipt of sound and generation of a corresponding second microphone signal, the second microphone coupled to the second audio input channel, and comprising a second positive power supply terminal and a second negative power supply terminal;

wherein the control and processing circuit further comprises:

a microphone supply terminal providing a second microphone supply voltage to the second microphone, and a second controllable switch comprising a second switch control terminal, the second controllable switch configured to selectively connect the second microphone supply voltage to, and disconnect the second microphone supply voltage from, the second microphone in accordance with a second switch control signal from the first output port, or a second output port, connected to the second switch control terminal; and wherein the control and processing circuit further comprises a plurality of preset listening programs, and wherein the control and processing circuit is configured for selectively:

connecting the first positive and first negative power supply terminals of the first microphone to the first microphone supply voltage, and disconnecting the second positive and second negative power supply terminals of the second microphone from the second microphone supply voltage, if a first one of the preset listening programs is selected to utilize the first microphone signal, and not the second microphone signal, as audio input;

connecting the first positive and first negative power supply terminals of the first microphone to the first microphone supply voltage, and connecting the second positive and second negative power supply terminals of the second microphone to the second microphone supply voltage, if a second one of the preset listening programs is selected to combine the first and second microphone signals in the signal processor.

7. The hearing instrument according to claim 1, further comprising:

a wireless receiver for receipt of a wireless modulated audio signal; and a decoder coupled to the wireless receiver for extracting a wireless audio signal and coupling the wireless audio signal to the second audio input channel or a third audio input channel of the control and processing circuit.

8. The hearing instrument according to claim 1, further comprising:

a second microphone; and a second controllable switch;

wherein the second controllable switch is external to the control and processing circuit.

9. The hearing instrument of claim 1, wherein the first microphone and the control and processing circuit are parts of the hearing instrument that is configured for worn by the user.

* * * * *